United States Patent [19]

Denomey

[11] Patent Number: 4,617,869

[45] Date of Patent: Oct. 21, 1986

[54] FOLDING TABLE, WORKBENCH OR THE LIKE

[76] Inventor: Ernest A. Denomey, 390 Lalonde Street, Belle River, Ontario, Canada, M0R 1A0

[21] Appl. No.: 558,483

[22] Filed: Dec. 6, 1983

[30] Foreign Application Priority Data

Jun. 23, 1983 [CA] Canada ..... 431035

[51] Int. Cl.[4] ..... A47B 3/00; A47B 83/02

[52] U.S. Cl. ..... 108/132; 108/121; 297/42; 297/142

[58] Field of Search ..... 297/140, 141, 142, 143, 297/159, 157, 172, 170, 240, 241, 42, 44; 108/121, 123, 132, 133, 157, 77, 59

[56] References Cited

U.S. PATENT DOCUMENTS

| | | | |
|---|---|---|---|
| 65,115 | 5/1867 | Poneroy | 297/142 |
| 317,097 | 5/1885 | Danuer | 108/132 |
| 334,946 | 1/1886 | Gage . | |
| 484,240 | 10/1892 | Rieckert | 297/44 |
| 867,816 | 10/1907 | Garret | 108/151 |
| 885,649 | 4/1908 | Rodrigues | 297/141 |
| 964,078 | 7/1910 | Winaus | 297/142 |
| 1,519,543 | 12/1924 | Kubinyi | 108/132 |
| 1,961,459 | 6/1934 | Sheldon | 297/142 |
| 2,077,414 | 4/1937 | Hunting . | |
| 2,558,465 | 6/1951 | Seymour | 297/159 |
| 2,866,495 | 12/1958 | Diehl et al. | 297/42 |
| 3,628,471 | 12/1971 | Burr | 108/132 |
| 3,734,235 | 5/1973 | Lanier . | |
| 4,055,124 | 10/1977 | Weagle | 108/132 |
| 4,079,679 | 3/1978 | Bechtold | 108/132 |
| 4,127,260 | 11/1978 | Hickman . | |
| 4,140,309 | 2/1979 | Hickman . | |
| 4,155,386 | 5/1979 | Alessio . | |
| 4,199,135 | 4/1980 | Wöhrle et al. . | |
| 4,221,173 | 9/1980 | Sarford, Jr. | 108/77 |
| 4,252,304 | 2/1981 | Pettican . | |

FOREIGN PATENT DOCUMENTS

| | | |
|---|---|---|
| 1024203 | 1/1978 | Canada . |
| 1076188 | 4/1980 | Canada . |
| 1110310 | 10/1981 | Canada . |
| 1117581 | 2/1982 | Canada . |
| 484512 | 6/1938 | United Kingdom . |

*Primary Examiner*—Francis K. Zugel
*Assistant Examiner*—Mark W. Binder
*Attorney, Agent, or Firm*—Laubscher & Laubscher

[57] ABSTRACT

The structure of a folding table, workbench or the like is simplified and the product made sturdy by providing the folding of legs of the table such that the legs are pivoted in pairs about two distinct, parallel pivot axes, so that the table folds generally in a parallelogram fashion. A brace member is disposed at each end of two beam sections, one for each pair of transversely adjacent legs. Each brace member is pivotable about an axis transverse to the first mentioned axes, from a position flush with the underside of the table or bench top to a protruding position engaging the respective transversely adjacent legs. Due to the mutually transverse arrangement of the pivoting axes, the overall arrangement is sturdy, simple and relatively inexpensive. Also disclosed is a modified design having a folding seat secured to the table or the like.

8 Claims, 12 Drawing Figures

FIG. 5
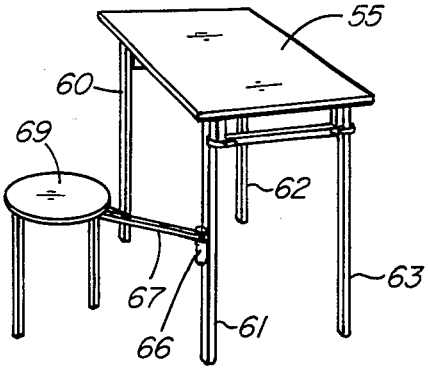
FIG. 6
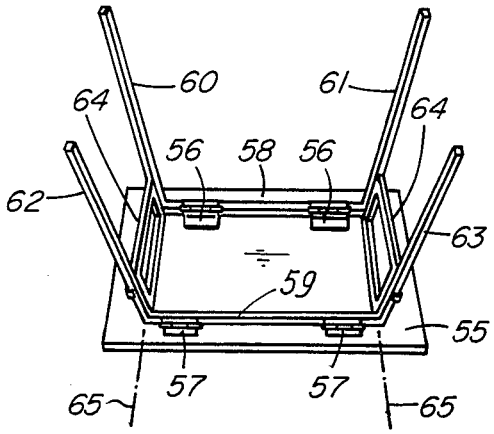
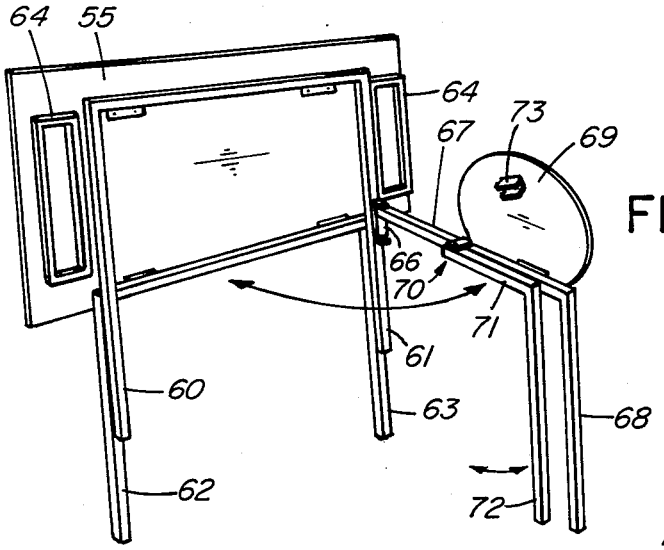
FIG. 8
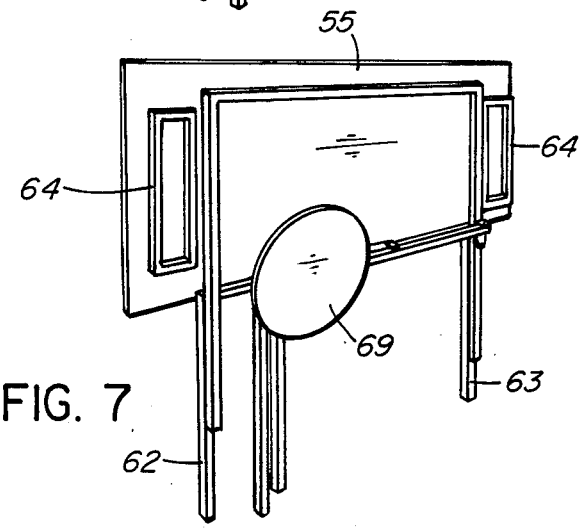
FIG. 7

FOLDING TABLE, WORKBENCH OR THE LIKE

FIELD OF THE INVENTION

The present invention relates to the art of folding tables, foldable workbenches or the like.

Portable, foldable workbenches, tables or the like have been known for many years. In general terms, the purpose of a folding table or the like is to secure that the table folds into a preferably flat condition such that it can be conveniently stored. Another desired property is that in the unfolded or assembled state, the table be as sturdy as possible without the need of having to apply heavy dimensions of certain parts thereof. Still another quality preferred in folding tables or the like is that the folding and unfolding be made as simple as possible without the need for special tools or for special skills of the persons folding or unfolding the table. Low production costs and simplicity of design are also desired.

DESCRIPTION OF PRIOR ART

Prior art relevant to the present invention is represented by the following patents: Canadian Pat. No. 1,024,203 (Hickman), issued Jan. 10, 1978; Canadian Pat. No. 1,110,310 (Alessio), issued Oct. 6, 1981; Canadian Pat. No. 1,117,581 (Hickman), issued Feb. 2, 1982; U.S. Pat. No. 334,946 (Gage), issued Jan. 26, 1886; U.S. Pat. No. 2,077,414 (Hunting), issued Apr. 20, 1937; U.S. Pat. No. 4,127,260 (Hickman), issued Nov. 28, 1978; U.S. Pat. No. 4,140,309 (Hickman), issued Feb. 20, 1979; U.S. Pat. No. 4,155,386 (Alessio), issued May 22, 1979; U.S. Pat. No. 4,199,135 (Woehrle), issued Apr. 22, 1980 and U.S. Pat. No. 4,252,304 (Pettican), issued Feb. 24, 1981.

The above list of patents presents but a very small fraction of different kinds of descriptions of known folding tables. From the standpoint of the present invention, the patents are of interest due to the fact that they all show the trend in folding tables or the like prevailing in the industry. In particular, the folding is made possible by pivotal securement of different sections of the table to each other, is effected by pivotal movement about a number of axes which are generally parallel with each other. This is disadvantageous due to the fact that such structures, when subjected to impacts or stresses directed generally parallel with the axes of the links or joints thereof, tend to be infirm or shaky unless the elements are made of extremely sturdy material which, in turn, produces the disadvantage of relatively high manufacturing cost.

The Hunting U.S. Pat. No. 2,077,414 discloses an arrangement of two pairs of legs such as legs 5, each pair being interconnected by and being integral with connecting bars 7. Hinges 6 secure the bars 7 to the top of the table and connecting rods 8, pivotable about pivots 9, secure the legs 5 in the unfolded position. All of the pivots, that is to say the pivots of the hinges securing the bars 7 to the top of the table and the pivots 9 of the connecting rods 8, are pivotable about axes which are generally parallel with each other. Accordingly, the structure suffers from the above drawback of relatively small rigidity in an unfolded state.

SUMMARY OF THE INVENTION

It is an object of the present invention to provide further advance in the art of folding tables, workbenches or the like by providing a folding table, workbench or the like which would be of a simple structure and would be relatively inexpensive to produce.

In general terms, and in one aspect thereof, the present invention provides a folding table, workbench or the like comprising, in combination: a bearing section adapted to form, in an unfolded state, a normally horizontal top section of the table; a pair of leg members, each leg member comprising a generally straight beam section and two leg sections, one at each end of the respective beam section, said leg sections being integral with and at an angle to the respective beam section, whereby each beam section and leg sections integral with same form a generally U-shaped configuration; first hinge means hingedly connecting the beam section of one of said leg members to said bearing section for pivotal movement about a first hinge axis generally parallel with the beam section of the said one of said leg members; second hinge means hingedly connecting the beam section of the other one of said hinge members to said bearing section for pivotal movement about a second hinge axis generally parallel with the beam section of the other one of said leg members and with said first hinge axis; a pair of brace members, each brace member being adapted for detachable securement to one leg section of each opposite leg members and being hingedly secured, by third hinge means, to said bearing section for pivotal movement about a third hinge axis disposed transversely of elongation of the first and second hinge axes and in a generally coplanar relationship with the first hinge axis.

Preferably, the angle between each beam section and the respective leg section is a right angle. It is also preferred that the third hinge axis be in general coincidence with corners of the leg members at which the respective leg sections coincide with the respective beam section, whereby the first, second and third pivot axes are disposed in a generally rectangular configuration.

In another respect, the present invention provides, in a folding table, workbench or the like, including leg sections normally generally vertical when the table, workbench or the like is unfolded, a folding seat assembly comprising: a seat arm having one end pivotably secured to one of said leg sections for pivotal movement about an axis generally parallel with the elongation of the respective leg section; the other end of said seat arm being integral with an auxiliary leg section generally parallel with said elongation and having a predetermined length adapted to maintain desired spacing of the other end of said arm above the ground; and a seat platform hingedly secured to said seat arm said other end thereof. Preferably, the seat platform is hingedly secured to the arm such that it pivots about an axis generally coincident with elongation of said seat arm, from a folded position wherein the surface of the platform is generally flush with a plane defined by the said seat arm and by said auxiliary leg section, to an extended position wherein the surface of the platform is generally perpendicular to the said plane.

BRIEF DESCRIPTION OF THE DRAWINGS

The invention will now be described by way of exemplary embodiments showed in the enclosed drawings. In the drawings:

FIG. 5 is diagrammatic view similar to FIG. 1 but showing a modified embodiment of the present invention;

FIG. 6 is a bottom perspective view of the embodiment shown in FIG. 5 with the seat assembly thereof removed for the sake of clarity;

FIG. 7 is a perspective view showing the table of FIG. 5 in a fully folded state inclusive the folded state of the seat assembly;

FIG. 8 is a perspective view showing the seat assembly of the table of FIG. 5 in a partly folded state;

DESCRIPTION OF PREFERRED EMBODIMENTS

Figure 1:
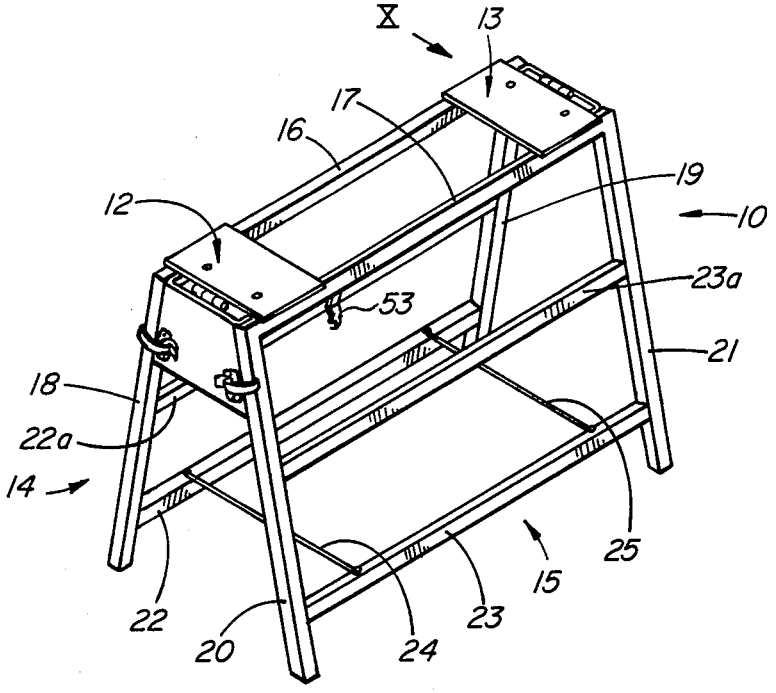
FIG. 1 is a simplified top perspective view of a workbench showing the features of a first embodiment of the present invention, with the top board of the workbench removed for the sake of clarity, the bench being shown in a fully unfolded state.

Turning now to the embodiment of FIGS. 1–4 and in particular FIG. 1, reference numeral 10 designates a workbench frame. When compared with the representation of FIG. 2 it will be observed that the frame 10 of FIG. 1 is shown without the top board 11 which is shown only in FIGS. 2, 3, and 4. FIG. 1 shows that the top of the assembly includes two hinge plates 12, 13, one at each end the bench. As seen from FIGS. 2–4, the hinge plates 12, 13 are each adapted for fixed securement to the underside of top board of the bench. Accordingly, the hinge plates 12, 13 present what can generally be referred to as a "bearing section" which is adapted to form, in an unfolded state as shown in FIG. 1, a normally horizontal top section of the table. Hingedly secured to the hinge plates 12 and 13 are two leg members, one each side of the bench. The leg member 14 and the leg member 15 are of a generally identical structural configuration. Each member has, at the top, a normally horizontal beam section 16, 17, respectively. The beam section 16 is integral, by way of welding, with a pair of leg sections 18, 19 and the beam section 17 is integral with similarly arranged leg sections 20, 21, respectively. A first reinforcing member 22 is disposed near the lower end of leg sections 18, 19 and a similar first reinforcing member 23 reinforces in the same fashion the leg member 15. Respective second reinforcing members 22*a* and 23*a* are disposed near the upper ends of the leg sections. In the shown embodiment, it is feasible to also employ connecting cables 24, 25 at each end of the workbench frame. The connecting cables 24, 25 are connected to the first reinforcing members 22, 23 to provide securement preventing the spreading apart of the leg members should the workbench be subjected to an extremely heavy load or impact. The securement of the cables to the reinforcing members 22, 23, is preferred as it brings the cables 24 out of reach of legs 18, 19, 20, 21 to facilitate the manipulation.

Figure 9:
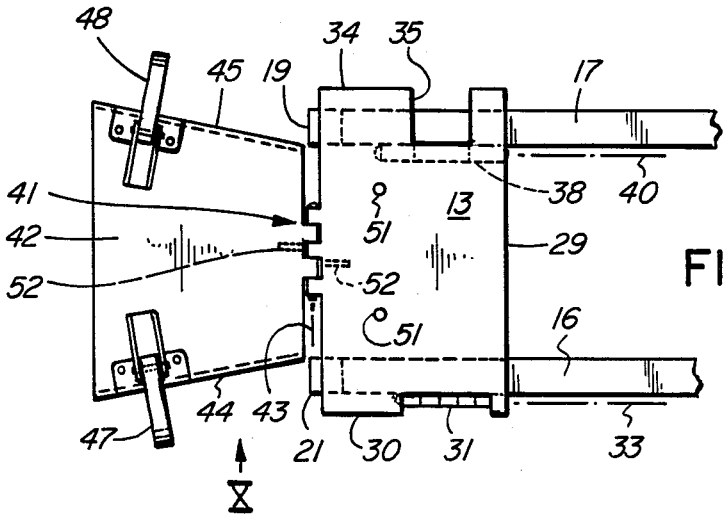
FIG. 9 is a top plan view of a slightly modified hinge plate arrangement similar to that used in the embodiment of FIG. 1.

The beam sections are interconnected with each other by way of two beam support plates or hinge plates 12, 13. The configuration of the hinge plates is apparent from FIGS. 9 and 10 even though the arrangement of these Figures is slightly modified. The reference numbers in FIGS. 10 and 11 correspond to those in the remaining drawings. Turning now to FIG. 9, the plate 13 is of a generally rectangular contour. The size of the plate, in the present embodiment, is approximately 220 mm as measured along the transverse side 29 and approximately 130 mm longitudinally, ie. along the longitudinal side 30.

The side 30 of plate 13 is also referred to as "first side" and is provided with one wing of a hinge 31, also referred to as "first hinge means". The second half of the hinge means 31 is welded to the beam section 16. The axis 33 is also referred to as "first hinge axis".

The second side 34 is provided with a cutout 35 producing a first wing 36 (FIG. 4) of a hinge. The second wings 37 and 38 of the hinge are welded to the beam section 17 in much the same fashion as shown with respect to the first mentioned hinge. With a hinge pin 39 (FIG. 10) inserted, the second hinge is adapted to pivotally secure the plate 13 to the beam section 17 for pivotal movement about a second hinge axis 40 in a fashion similar to the first hinge 31. A transverse third hinge 41 secures a brace member of the type of a brace plate 42 to the plate 13. Thus, the plate 42 is secured to plate 13 by the third hinge 41, for pivotal movement about a third hinge axis 43. The plate 42 is of trapezoidal configuration with its minor base section generally coinciding with the third hinge axis 43.

Figure 10:
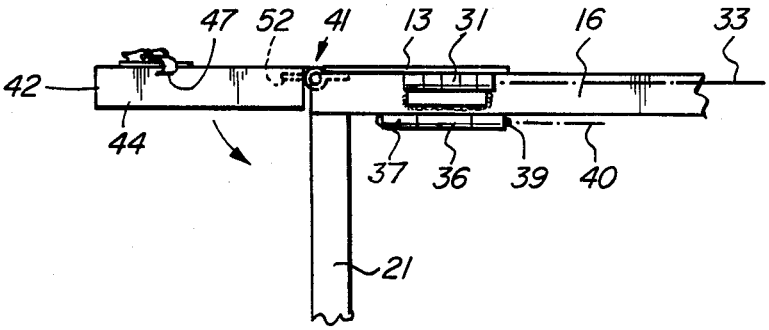
FIG. 10 is a side view of the plate of FIG. 9 taken in the direction X of FIG. 1.

With reference to FIG. 10, it will be seen that the third hinge 41 is coplanar with hinge 31, the axes 33, 43 of the first and third hinges being spaced vertically from the second hinge axis 40 by a spacing corresponding to the vertical thickness of the beam 17. For convenience, however, the three axes 43, 33 and 40 can be considered to be in a generally coplanar relationship since the displacement between axes 33 and 40 is only for the purpose for securing parallel and stacked arrangement of legs 19, 21 when the table is in folded position.

The sides of the trapezoidal plate 42 are formed by two flanges 44, 45 whose width generally corresponds to the width of the respective leg sections 19, 21. Thus, the plate 42 can be brought from a position shown in FIG. 9 (wherein it would be flush with the associated top board 11), over an intermediate position to a generally vertical position in which the flanges 45, 44 of the plate 42 are placed against the leg sections 19, 21, the leg sections 19, 21 being shown only diagramatically in FIGS. 9 and 10. The flanges 44, 45 are each associated with a clamp 47, 48 adapted to engage the respective leg sections 21, 19 and thus hold the inner surfaces 49, 50 (FIGS. 4, 3, respectively) of leg sections 19, 21, in engagement with the flanges 45, 44. Thus, the plate 42 is instrumental in bracing the pair of legs at each end of the bench in a generally trapezoidal or pyramidal configuration visible from FIGS. 1 or 2. In addition, the connecting cables 24, 25 can be employed as mentioned above. Openings 51 in the plate 13 serve the purpose of securement of the plate to the associated board 11. If the brace plate 42 were of rectangular configuration, the fully unfolded state would be that of a generally upright configuration of the leg sections 18–21.

Figure 2:
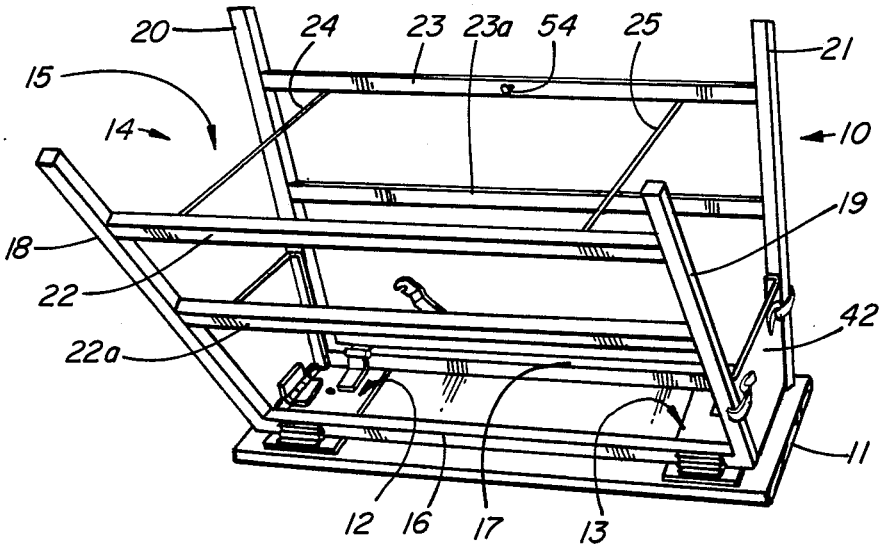
FIG. 2 is a bottom perspective view of the arrangement in FIG. 1.
Figure 3:
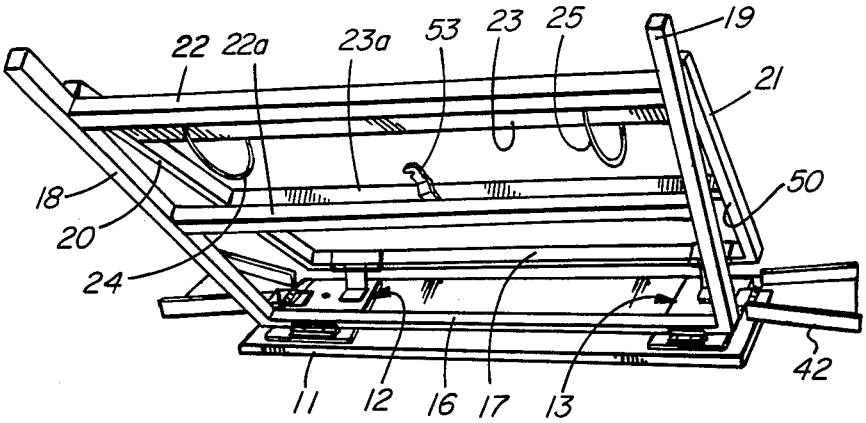
FIG. 3 is a view similar to FIG. 2 but showing the table of FIG. 1 in a partly folded position.
Figure 4:
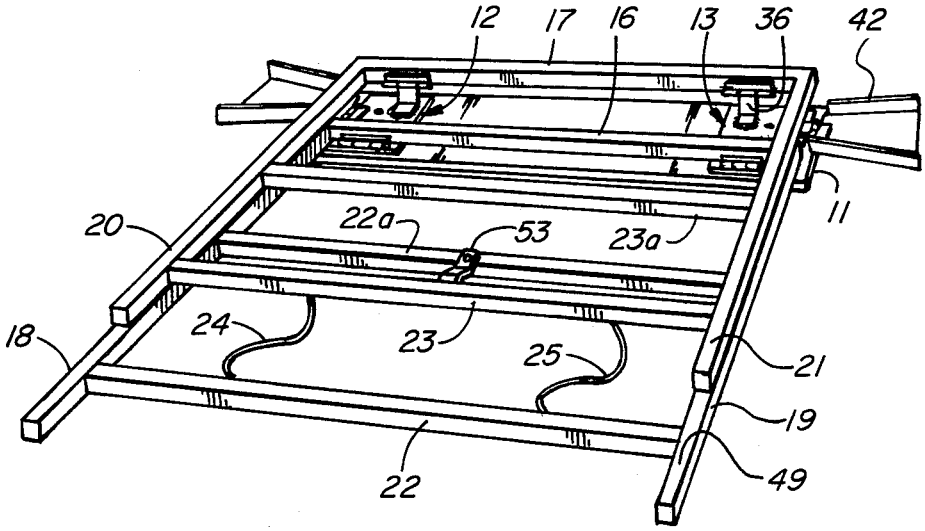
FIG. 4 is a view similar to FIG. 2 but showing a fully folded position.

From the above, it will be readily appreciated that the folding of the bench as shown in FIGS. 1 and 2 follows the steps of simply releasing clamps 47, 48, pivoting the brace plates such as plate 42 outwardly, whereupon the leg sections can be folded from the fully erected position of FIG. 2 over the state of FIG. 3 to the fully folded state of FIG. 4 in which the leg sections 19 and 21 are stacked side-by-side against each other. Suitable means can be provided, if necessary, for holding the brace plate 42 in its "open" state, for instance a magnet (not shown) at the underside of the top board 11 or hinge springs such as spring 52 shown in FIG. 10. A lock lever 53 pivots on member 22*a* and engages a pin 54 fixed to the number 23 to hold the bench in a folded state.

Those skilled in the art will readily appreciate that a great number of different modifications of the present invention may exist. One such modification is shown in the FIGS. 5–8. It should be realized that in these figures, the bottom view of FIG. 6 is intended to merely indicate the correspondence of the arrangement of this second embodiment with the first embodiment described above. Therefore, certain parts of the overall structure of FIGS. 5, 7 and 8 are not shown in FIG. 6.

As in the first embodiment, there is a bearing section adapted to form in an unfolded state a normally horizontal top section of the table. In the second embodiment, however, such section is formed solely by a top board 55, to which is fixedly secured one-half of first hinges 56 and one half of second hinges 57, the opposite halves of such hinges being secured to the respective beam sections 58, 59. As in the first example, the beam section 58 is integral with two leg sections 60, 61 and the beam section 59 is integral with leg sections 62 and 63. Instead of the brace plates 42 of the first embodiment, the brace members of the table of the second embodiment are formed by rectangular frame members such as frame members 64 (FIG. 8) which is provided with clips or other fasteners similar to the clips 47, 48 (only diagramatically indicated in FIGS. 5 and 6). Since the brace frames 64 of the second embodiment are generally rectangular, the legs 60, 61, 62 and 63 are disposed vertically when the table is erected, as opposed to the inwardly and upwardly inclined pyramidal fashion of the first embodiment. There is no plate similar to plate 12 of the first embodiment. Instead, the brace frames 64 are each secured to the board 55 for hinged, pivotal movement about a pivot axis 65 (FIG. 6). Thus, the axes 65 are the "third pivot axes" of the second embodiment.

If desired, the last mentioned embodiment may be provided with a folding seat section which is basically comprised of a hinge 66 by which one end of a seat arm 67 is pivotally secured to the leg 61 (FIG. 8). The opposite end of the seat arm is integral with an auxiliary leg section 68. A seat platform 69 is hingedly secured to the seat arm 67 for pivotal movement about an axis generally coincident with elongation of the seat arm 67. Thus, the seat platform 69 can assume a folded position shown in FIG. 8 and can be turned down to a horizontal unfolded position shown in FIG. 5. Another hinge 70 connects to the seat arm 67 a horizontal supporting frame member 71 which, in FIG. 8, is generally flush with the seat arm 67. The supporting frame member 71 is integral with a generally vertical second auxiliary leg section 72. A clip 73 mounted at the lower surface of the seat platform 69 is adapted to engage the supporting frame member 71 when the overall assembly is in a fully unfolded state shown in FIG. 5. It will be seen on review of FIG. 5 that the overall assembly presents a simple arrangement including a seat which can be placed at a selected distance from the table itself by pivoting the seat arm 67 about the hinge 66.

Figure 11:
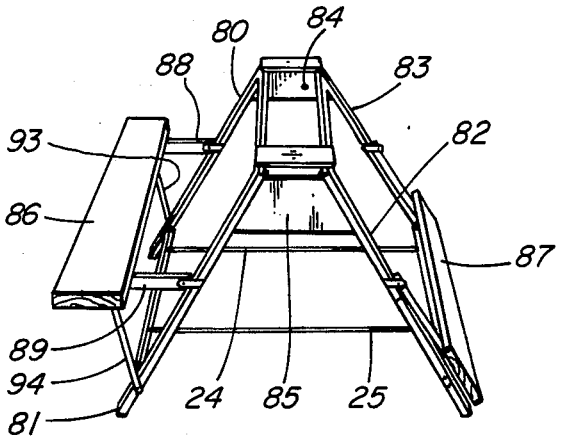
FIG. 11 is a simplified perspective partial view similar to FIG. 1 but showing a still further embodiment of the present invention.
Figure 12:
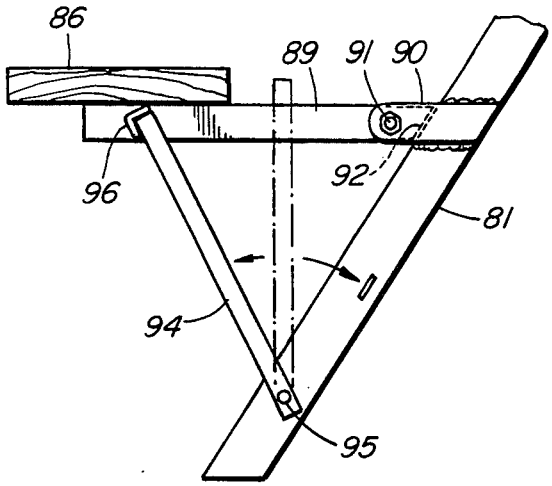
FIG. 12 is a detail of the embodiment of FIG. 11 in an end view.

FIGS. 11, 12 indicate that the basic principle of the present invention can also be utilized in the art of picnic tables or the like. The structure shown in FIG. 11, as far as the folding table feature is concerned is similar to what is shown in FIG. 1. It is therefore not necessary to describe all of the details of the arrangement. It will suffice to say that the figure shows four legs 80, 81, 82 and 83 which are functional counterparts of leg sections 18, 19, 20 and 21 described in the first embodiment or 60, 61, 62 and 63 of the embodiment of FIGS. 5–8. Reference numerals 84, 85 designate brace plates each of which forms a functional counterpart of the brace plate 42 referred to above.

The embodiment of FIG. 11 is provided with two longitudinal seats 86, 87 which can assume an erected position (at the left of FIG. 11) and a folded position in which the seat 87 is generally flush with the plane defined by the leg members 82, 83. Each seat 86 is secured to its respective pair of legs 80, 81 by a pair of arms 88, 89 pivotally secured to respective legs 80, 81. Fixedly secured to each arm 88, 89 is the underside of the respective seat 86.

The end of each arm 88, 89 near the respective leg 80, 81 is so shaped as to allow the pivoting of the arm 88, 89 only within an angle limited by the horizontal position as shown at the left hand side of FIG. 11 and by the respective plane defined by the associated legs 80, 81. In other words, the seat 86 cannot be lifted above the horizontal level shown at the left hand side of FIG. 11. This is achieved, in the shown embodiment, by an arrangement whereby by the seat arm 89 (and also 88, but only 89 being shown in FIG. 12) is secured to a pair of brackets of which only bracket 90 is visible in FIG. 12. The arm 89 thus pivots about the pivot of the bracket 90, the pivot being marked with reference numeral 91. The free end of the arm 89 is bevelled at 92 so that in an extended position shown in FIG. 12, the bevel 92 engages the surface of the respective leg 81. Thus, the arm 89 cannot move further clockwise from the horizontal position shown in FIG. 12. The bracket 90 is welded to the respective leg.

It will be apparent from the above that the arm 89 (and thus 88) can move from a horizontal position shown at the left of FIG. 11 to a position generally flush with a plane defined by the two legs 80, 81 shown at the right of the same Figure.

It is also shown in FIG. 11 that two support members 93, 94 are employed in supporting the seat 86, the two being of identical configuration. Therefore, FIG. 12 only shows the forward member 94 which is pivotably secured to the respective leg 81 at 95. The free end of the support member 94 is adapted to engage an L-shaped bracket 96 welded to the seat arm 89. When fully engaged, the free end of the support member 94 supports the respective seat arm 89 in horizontal position by snugly engaging the inside of the bracket 96. Thus, the arrangement of FIG. 12 shows one embodiment wherein the support member 94 can assume a first functional position in which it supports the seat 86 and a second position in which it is flush with the leg 81 when the overall assembly is in a folded state.

Those skilled in the art will readily appreciate from the above two examples that various modifications and changes may be effected in folding workbenches, tables or the like which may differ from the embodiments described above without departing from the scope of the present invention as recited in the accompanying claims.

I claim:

1. A folding table, workbench or the like comprising in combination:

(a) a bearing section adapted to form, in an unfolded state, a normally horizontal top section of the table;

(b) a pair of leg members, each leg member comprising a generally straight beam section and two leg sections, one of said leg sections being arranged at each end of the respective beam section, said leg sections being integral with and at an angle to the respective beam sections, whereby each beam section and the leg sections integral therewith form a generally U-shaped configuration;

(c) first hinge means hingedly connecting the beam section of one of said leg members to said bearing section for pivotal movement about a first hinge axis generally parallel with the beam section of said one of said leg members;

(d) second hinge means hingedly connecting the beam section of the other one of said leg members to said bearing section for pivotal movement about a second hinge axis generally parallel with the beam section of the other one of said leg members and with said first hinge axis;

(e) a pair of brace members, each of said brace members including a base portion adjacent said bearing section and two opposed side portions, each side portion defining an outwardly facing, generally planar edge section;

(f) third hinge means for connecting said brace member base portions with said bearing sections, respectively, for pivotal movement about third hinge axes disposed transversely to said first and second hinge axes and generally coplanar with said bearing section; and (g) a pair of releasable clamping devices connected with opposite sides of each of said brace members, said clamping devices including a clamping portion engaging the outer edge of said leg sections and operable to hold said leg sections against the adjacent edge section of said brace member side portions, respectively, to rigidly secure said leg members relative to said brace members and said bearing section to improve the stability of the table in the unfolded condition.

2. A folding table or the like as claimed in claim 1 wherein the angle between each beam section and the respective leg sections is an obtuse angle.

3. A folding table or the like as claimed in claim 1, wherein said bearing section includes two hinge plate members each comprising an integral, generally rectangular plate section, the hinge plate section of each hinge plate member being disposed one at each end of the bearing section, each hinge plate section being of a generally rectangular contour and forming a hinge wing along three of four sides thereof, each said plate being provided with means for securement of the respective plate to a top board or the like.

4. A folding table or the like as claimed in claim 1, wherein each of said brace members is a rectangular frame member, whereby said leg sections are generally vertical when the table or the like is in unfolded state.

5. A folding table or the like as claimed in claim 1, wherein each of said brace members is a rectangular frame member, whereby said leg sections are generally vertical when the table or the like is in unfolded state, said table or the like further comprising a seat assembly which includes:

(a) a seat arm having one end pivotably secured to one of said leg sections for pivotal movement about an axis generally parallel with the elongation of the respective leg sections;

(b) the other end of said seat arm being integral with an auxiliary leg section generally parallel with said elongation and having a predetermined length adapted to maintain a desired spacing of the other end of said arm above the ground;

(c) a seat platform hingedly secured to said seat arm for pivotal movement about an axis generally coincident with elongation of said seat arm, from a folded position wherein the surface of the platform is generally flush with a plane defined by said seat arm and by said auxiliary leg section, to an unfolded position wherein the surface of the platform is generally perpendicular to the said plane;

(d) a seat platform supporting frame member having a generally L-shaped configuration whose one arm forms a second auxiliary leg section corresponding in length to the length of the first auxiliary leg section, and a normally horizontal support arm whose free end is hinged to the seat arm for pivoting about an axis generally parallel with the elongation of the leg sections, at an intermediate hinge adapted to allow movement of said support arm from a folded position flush with the seat arm to an unfolded position wherein the support arm and the seat arm form a normally horizontal V-shaped configuration; and (e) retaining means adapted to maintain said V-shaped configuration of said seat arm and said support arm.

6. A folding table or the like as claimed in claim 1, wherein each of said brace members is a rectangular frame member, whereby said leg sections are generally vertical when the table or the like is in unfolded state, said table or the like further comprising a seat assembly which includes:

(a) a seat arm having one end pivotably secured to one of said leg sections for pivotal movement about an axis generally parallel with the elongation of the respective leg sections;

(b) the other end of said seat arm being integral with an auxiliary leg section generally parallel with said elongation and having a predetermined length adapted to maintain a desired spacing of the other end of said arm above the ground;

(c) a seat platform hingedly secured to said seat arm for pivotal movement about an axis generally coincident with elongation of said seat arm, from a folded position wherein the surface of the platform is generally flush with a plane defined by said seat arm and by said auxiliary leg section, to an unfolded position wherein the surface of the platform is generally perpendicular to the said plane;

(d) a seat platform supporting frame member having a generally L-shaped configuration whose one arm forms a second auxiliary leg section corresponding in length to the length of the first auxiliary leg section, and a normally horizontal support arm whose free end is hinged to the seat arm for pivoting about an axis generally parallel with the elongation of the leg sections, at an intermediate hinge adapted to allow movement of said support arm from a folded position flush with the seat arm to an unfolded position wherein the support arm and said seat arm form a normally horizontal V-shaped configuration; and (e) retaining means adapted to maintain said V-shaped configuration of said seat arm and said support arm, said retaining means including a clip fixedly secured to an underside surface of said seat platform and adapted to releasably fasten the platform to said support arms.

7. A folding table or the like as defined in claim 1, wherein said third hinge axes are generally perpendicular to the first and second hinge axes, the third hinge axes each being adjacent the respective ends of the beam sections of said leg members, whereby the axes of the first, second and third hinges form a generally rectangular arrangement, and further wherein each brace member is of a trapezoidal shape having a minor base section adjacent the respective third hinge axis, whereby the leg members, in unfolded state, are each planar and generally vertically arranged to converge in the direction from the free ends of the leg sections inwardly to the bearing section in a pyramid-like fashion.

8. In a folding table, workbench or the like, including leg sections normally generally vertical when the table, workbench or the like is unfolded, a folding seat assembly comprising, in combination:

(a) a seat arm having one end pivotally secured to one of said leg sections for pivotal movement about an axes generally parallel with the elongation of the respective leg sections;

(b) the other end of said seat arm being integral with an auxiliary leg section generally parallel with said elongation and having a predetermined length adapted to maintain a desired spacing of the other end of said arm above the ground;

(c) a seat platform hingedly secured to the said seat arm near said other end thereof, said seat platform being arranged for pivotal movement about an axes generally coincident with elongation of said seat, arm, from a folded position, wherein the surface of the platform is generally flush with a plane defined by said seat arm and by said auxiliary leg section, to an unfolded position wherein the surface of the platform is generally perpendicular to the said plane;

(d) a seat platform supporting frame member having a generally L-shaped configuration whose one arm forms a second auxiliary leg section corresponding in length to the length of the first auxiliary leg section, and a normally horizontal support arm whose free end is hinged to the seat arm for pivoting about an axis generally parallel with elongation of the leg sections, at an intermediate hinge adapted to allow movement of said support arm from a folded position flush with the seat arm to an unfolded position wherein the support arm and said seat arm form a normally horizontal V-shaped configuration; said combination including retaining means adapted to maintain said V-shaped configuration of the seat arm and said support arm.

* * * * *